US005340288A

United States Patent [19]

Mikiya et al.

[11] Patent Number: 5,340,288

[45] Date of Patent: Aug. 23, 1994

[54] ELECTROMAGNETIC PUMP

[75] Inventors: Toshio Mikiya; Toshio Osada, both of Tokyo, Japan

[73] Assignee: Nitto Kohki Co., Ltd., Tokyo, Japan

[21] Appl. No.: 998,428

[22] Filed: Dec. 30, 1992

[30] Foreign Application Priority Data

Jan. 10, 1992 [JP] Japan ..... 4-004169[U]

[51] Int. Cl.[5] ..... F04B 17/04

[52] U.S. Cl. ..... 417/417

[58] Field of Search ..... 417/417, 418

[56] References Cited

U.S. PATENT DOCUMENTS

| | | | |
|---|---|---|---|
| 3,542,495 | 11/1970 | Barthalon | 417/416 |
| 4,116,591 | 9/1978 | Mardell | 417/417 |
| 5,100,304 | 3/1992 | Osada et al. | 417/417 |

FOREIGN PATENT DOCUMENTS

| | | |
|---|---|---|
| 0014817 | 1/1984 | European Pat. Off. . |
| 2242586 | 3/1973 | Fed. Rep. of Germany . |
| 3421463A1 | 3/1985 | Fed. Rep. of Germany . |
| 2498027 | 1/1982 | France . |
| 1220857A | 4/1968 | United Kingdom . |
| 1574132 | 3/1976 | United Kingdom . |
| 2044842A | 11/1979 | United Kingdom . |
| 2047336A | 11/1979 | United Kingdom . |

*Primary Examiner*—Richard A. Bertsch
*Assistant Examiner*—Alfred Basichas
*Attorney, Agent, or Firm*—Westman, Champlin & Kelly

[57] ABSTRACT

The inside-outside positional relationship between a field core of an electromagnet and an armature provided on a piston in an electromagnetic pump is reversed as compared with the prior art pump, that is, an annular armature is placed outside and a field core is placed inside the armature. The annular armature attached to the piston reciprocates in the axial direction thereof and the inside surface of the armature is opposed to the outside circumference of the field core of an electromagnet having formed thereon a plurality of outwardly and radially projecting magnetic poles, and being fixed to a part of a casing.

13 Claims, 4 Drawing Sheets

ELECTROMAGNETIC PUMP

BACKGROUND OF THE INVENTION

1. Field of the Invention

The present invention is related to an electromagnetic pump, and particularly to an electromagnetic pump of the type in which a fluid is sucked and discharged by reciprocating a piston using the attracting action of an electromagnet and the repulsive action of a spring means.

2. Description of the Prior Art

Publicly known is an electromagnetic pump of the type in which a piston head placed for sliding in a cylinder and having a piston is biased in one direction by a spring and the piston is periodically attracted in the direction opposite to the above direction using an electromagnet to repetitively such and discharge a fluid.

Attached to the piston is an armature which is formed by laminating a plurality of doughnut-like plates of a magnetic material. The piston is cast after the armature is fitted into the mold of the piston.

The electromagnet for attracting the armature constitutes of a pair of magnetic poles placed outside the armature, a field core of a hollow, rectangular material placed around the armature, and coils wound around the magnetic poles.

In the conventional electromagnetic pump described above, the electromagnet for attracting the armature has a large size and heavy weight, and as a result, the electromagnetic pump is also large-sized and heavy. The reason for this is as follows:

(1) The spring means and shaft for biasing the piston in one direction are disposed so that the end portions of them are adjacent to the armature, the end portions are positioned close to or within the magnetic gaps between the armature and the magnetic poles of the field core, and the magnetic path is long. Thus, the magnetic fluxes generated in the electromagnet are susceptible to leakage.

The spring means may be remotely positioned to prevent the magnetic leakage, but it may cause a large-size and heavy weight of the moving portion. In addition, the spring means may be formed of non-magnetic materials such as stainless wire, but these materials are not preferred because they have unstable mechanical properties and a small stress of shear strength. Accordingly, the spring means should be formed using a magnetic material which has unstable mechanical properties and a large allowable stress or shear strength (e.g. steel for spring), but in this case, the magnetic leakage becomes large and it is required to increase the magnetomotive force (ampereturns) of the coils to be wound around the magnetic poles or field core.

(2) In the conventional electromagnetic pump as discussed above, a field core having magnetic poles is a hollow, rectangular material and it is placed outside an armature so as to surround the armature, and thus the field core is large-sized. Consequently, the amount of the magnetic material constituting the field core and armature will increase.

Since the rectangular field core results in a relatively long magnetic path and also a large magnetic leakage, it is required to increase the magnetomotive force of the coils to be wound around the field core.

SUMMARY OF THE INVENTION

The object of the present invention resides in making the magnetic flux leakage between the field core and the armature as small as possible and making the electromagnet small in size and light in weight, thereby to make the electromagnetic pump light in weight and small in size.

The present invention is characterized in that the inside-outside positional relationship between the field core of the electromagnet and the armature provided on the piston in the electromagnetic pump is reversed as compared with the prior art pump, that is, an annular armature is placed outside and a field core is placed inside the armature. Specifically, it is characterized in that the annular armature attached to the piston reciprocates in the axial direction thereof and the inside surface of the armature is opposed to the outside circumference of the field core of an electromagnet having formed thereon a plurality of outwardly and radially projecting magnetic poles, and being fixed to a part of a casing.

When the electromagnet consisting of the field core and the coils wound around it is energized, the field core is magnetized and the armature and piston are attracted by the field core. When the electromagnet is de-energized, the piston moves in the direction opposite to the direction of attraction by the repulsive force of the spring means placed adjacently to the piston. Accordingly, if the electromagnet is energized with a half-wave alternating current for instance, the piston reciprocates and suction/discharge of a fluid is performed. In this case, since the spring means is placed at a position remote from the field core and armature, the magnetic leakage is reduced.

DETAILED DESCRIPTION OF THE PREFERRED EMBODIMENT

Figure 1:
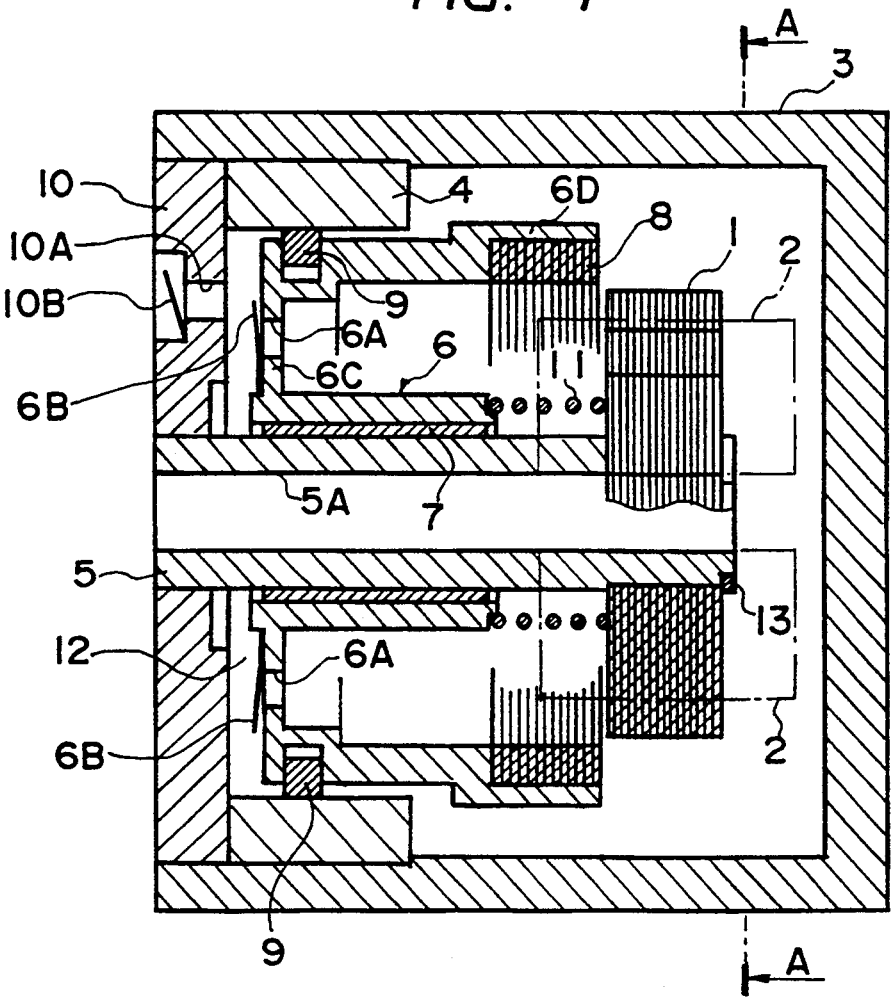
FIG. 1 is a cross-sectional view of the first embodiment of the present invention.
Figure 2:
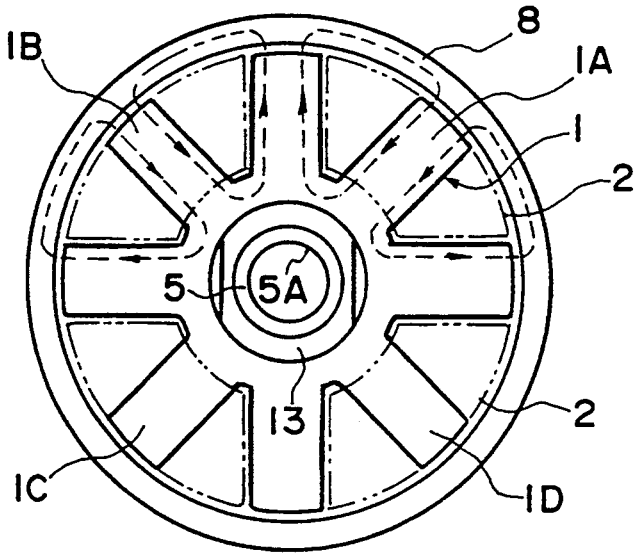
FIG. 2 is a sectional view along A—A of FIG. 1.

The present invention is now described with reference to the drawings. FIG. 1 is a cross-sectional view of the first embodiment of the present invention, and FIG. 2 is a sectional view along A—A of FIG. 1. In FIG. 2, coils 2 are shown by two-dot chain lines, and casing 3, cylinder wall 4, holding portion 6D of piston 6 for supporting armature 8 and the like are omitted, and the flows of the magnetic fluxes emanating from magnetic poles 1A and 1B of the eight magnetic poles of field core 1 are shown by dashed lines.

In FIG. 1, cylinder head 10 has a hollow main shaft 5 attached at one end of it to the center thereof and has cylinder wall 4 attached to the inner circumferential portion thereof so that the central axis of cylinder wall 4 coincides with the central axis of the main shaft 5.

Cylinder wall 4 and cylinder head 10 constitute the cylinder of the electromagnetic pump. Discharge port 10A is provided in cylinder head 10 at a portion which is further inside from the cylinder wall 4, and the discharge port 10A is provided with discharge valve 10B. In this figure, for convenience, discharge valve 10B is shown as opened. Inserted for sliding over the outer circumferential surface of main shaft 5 is piston 6, which has piston head 6C at one end thereof and holding portion 6D. Holding portion 6D may take any shape as long as it can support the armature 8 from the outside thereof as described later.

Slide bearing 7 is desirably provided between the outer peripheral surface of the main shaft 5 and the inner peripheral surface of piston 6, whereby piston 6 is smoothly reciprocated. Compression chamber 12 is defined by the cylinder consisting of the cylinder wall 4 and cylinder head 10, and piston head 6C.

The piston head 6C is provided with suction ports 6A, which are again provided with suction valves 6B. FIG. 1 shows the moment piston 6 has started a forward movement (movement in the direction in which the later described compression coil spring 11 is compressed), and suction valves 6B are shown as opened.

Piston ring 9 is mounted around the piston head 6C. The holding portion 6D has an annular armature 8 mounted on the inner wall thereof. Armature 8 can be integrally built in with piston 6 when the piston is formed.

At the other open end of the main shaft 5, field core 1 is fixed by nut 13. Field core 1 has, for example, eight magnetic poles which are outwardly radially projecting, as shown in FIG. 2, and it is formed so that the outer end faces of them are positioned slightly inwardly of the inner peripheral surface of the armature 8, so that a very small air gap is left between the outer end face of each magnetic pole and the inner peripheral surface of armature 8, and coils 2 are wound around every other one of the magnetic poles (four magnetic poles designated by symbols 1A–1D in FIG. 2). The winding of coil 2 is performed so that a closed magnetic circuit is formed as partly shown by dotted arrows in FIG. 2 and the magnetic flux produce a closed loop through armature 8 between adjacent magnetic poles. The field core 1 and coils 2 constitute the electromagnet of the electromagnetic pump. The field core 1 is mounted so that its central axis coincides with the central axis of the armature 8.

As described later, the outside air flows into casing 3 through fluid passage 5A in main shaft 5 when the electromagnetic pump operates, and to improve the heat dissipation ability of main shaft 5 in this case, radiating fins (not shown) may be formed on the inner surface of the fluid passage 5A in the axial direction of main shaft 5. The fins may be integrally formed with main shaft 5, or they may be formed by setting the ones formed separately from main shaft 5 in the inner surface of fluid passage 5A through thermal connection.

Compression coil spring 11 is placed between the field core 1 and piston 6 with the same central axis as them. It is desirable to locate a thrust bearing or similar freely rotatable ring, not shown, at one end of the compression coil spring 11 thereby enable piston 6 to freely rotate within cylinder wall 4.

When coils 2 are energized in the first embodiment of the present invention having the above construction, magnetic fluxes form closed loops between stationary field core 1 and armature 8, and the armature 8 is attracted to stationary field core 1, against the repulsive force of compression coil spring 11, whereby the volume of compression chamber 12 increases. Since this causes suction valves 6B to open and discharge valve 10B to close, the fluid (air) in casing 3 is caused to flow into compression chamber 12 from suction ports 6A.

When coils 2 are de-energized, piston 6 returns to the initial position (in the state of FIG. 1) by the repulsive force of compression coil spring 11. Since this causes suction ports 6A to be blocked with suction valves 6B and the volume of compression chamber 12 decreases, the fluid in the compression chamber 12 is pressurized to open discharge valve 10B and discharged to the outside through discharge port 10A. At this point, the pressure in casing 3 decreases and the outside air flows into the casing 3 through fluid passage 5A.

Figure 3:
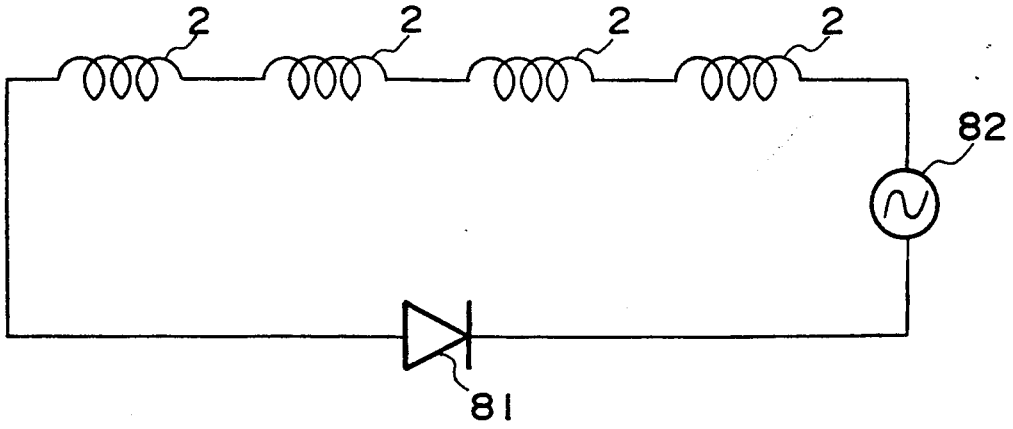
FIG. 3 is a circuit diagram showing an example of the electric circuit of the first embodiment of the present invention.

As shown in FIG. 3, if four coils 2 and diode 81 are connected in series to a.c. power supply 82 and coils 2 are energized with a hale-wave alternating current, then piston 6 forwardly moves when coils 2 are energized and compression coil spring 11 acts to cause piston 6 to backwardly (in the direction opposite to the forward movement) move when coils 2 are de-energized, and this operation is repeated in synchronism with the frequency of the alternating current.

As a result, the fluid introduced into casing 3 through fluid passage 5A is continuously discharged to a consumption source or pressure reservoir, not shown, through discharge port 10A and discharge valve 10B. Coils 2 may be energized with a pulse-like current instead of an alternating current.

In this example, since the fluid passes through the fluid passage 5A of main shaft 5 supporting the reciprocating piston 6 while suction and discharge of the fluid are repetitively performed, the main shaft 5 is cooled from the inside thereof. The fluid, after passing through the inside of main shaft 5, enters casing 3 and cools coil 2 and field core 1 as well as piston 6 and armature 8, and in addition, bearing 7 supporting piston 6 prevents the temperature rising of the piston 6 due to sliding friction.

Figure 4:
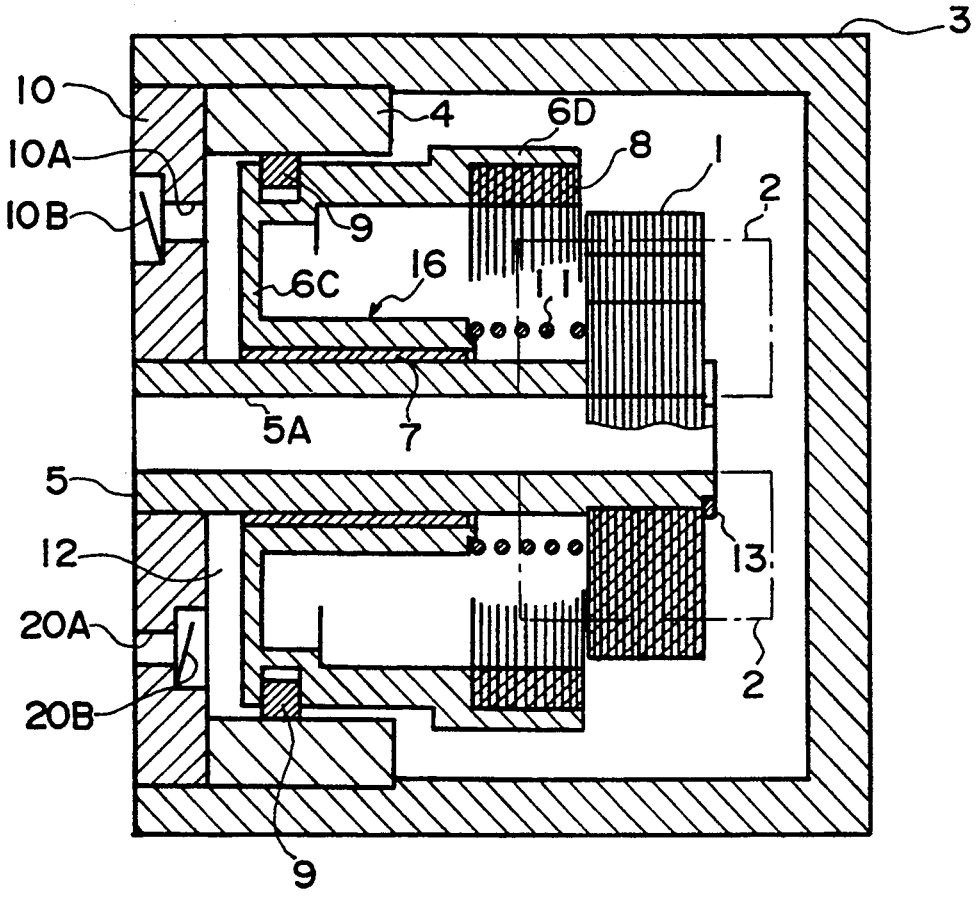
FIG. 4 is a cross-sectional view of the second embodiment of the present invention.

FIG. 4 is a cross-sectional view of the second embodiment of the present invention in which the same symbols as FIG. 1 represent the same or identical portions. As apparent from comparison with FIG. 1, in this embodiment, the suction port and suction valve provided in piston head 6C in FIG. 1 are provided in the cylinder head 10 side (refer to symbols 20A and 20B). Since the suction port and suction valve as well as the discharge port and discharge valve only need to be provided in the wall of compression chamber 12, they may be formed in cylinder wall 4.

In addition, fluid passage 5A is provided to absorb the pressure change in casing 3 which varies according to the reciprocation of piston 6, and it is not to positively pass a fluid through it. Accordingly, for instance, it may be allowed to block up fluid passage 5A and form an opening in an appropriate portion of casing 3.

Figure 5:
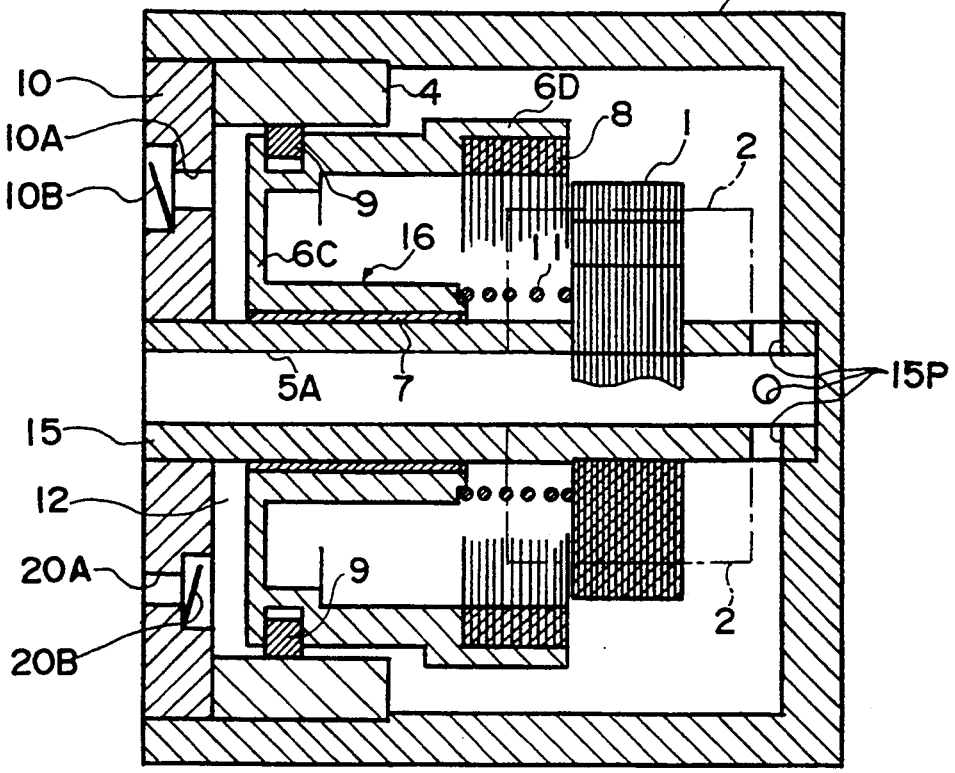
FIG. 5 is a cross-sectional view of the third embodiment of the present invention.

FIG. 5 is a cross-sectional view of the third embodiment of the present invention in which the same symbols as FIG. 4 represent the same or identical portions. As apparent from comparison with FIG. 4, in this embodiment, main shaft 15 supporting piston 16 is provided with a closed-sided structure. That is, the hollow main shaft 15 is fixed to cylinder head 10 at one end thereof and to casing 3 at the other end. Opening 15P is formed in the main shaft 15 at the end portion thereof fixed to casing 3 so as to allow fluid passage 5A and casing 3 to communicate with each other.

Such closed-sided structure of main shaft 15 may be applied to an electromagnetic pump wherein suction ports 6A and suction valves 6B are provided in piston head 6C, such as shown in FIG. 1. In this case, when the electromagnetic pump operates, the outside air flows into casing 3 through fluid passage 5A and its opening 15P, whereby the inside of the main shaft 15 and casing 3 is positively cooled.

Figure 6:
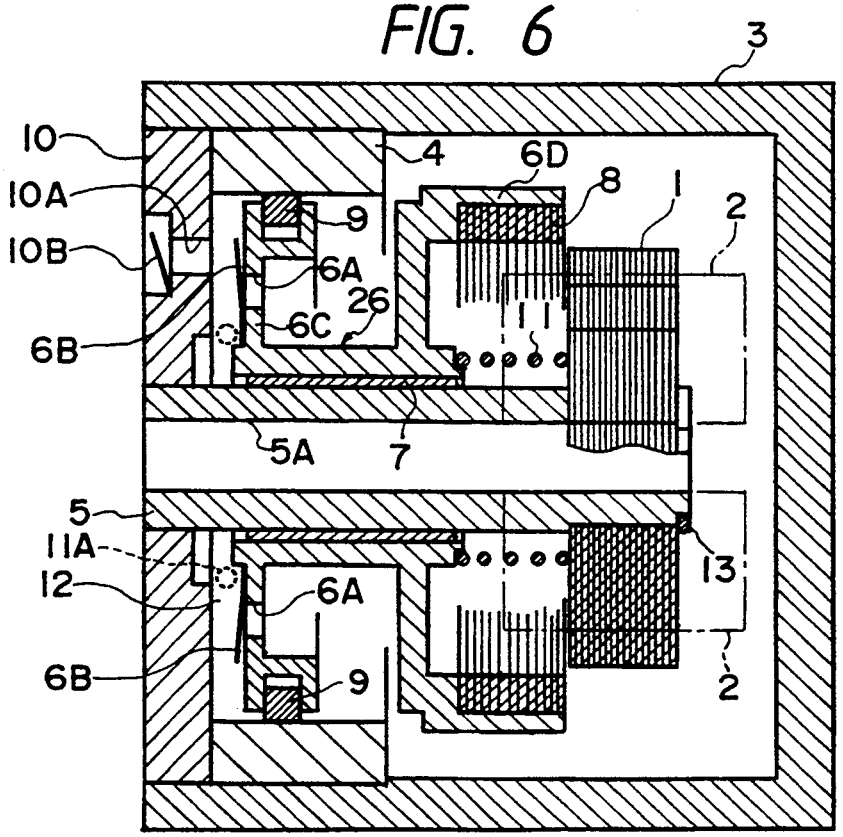
FIG. 6 is a cross-sectional view of the fourth embodiment of the present invention.

FIG. 6 is a cross-sectional view of the fourth embodiment of the present invention in which the same symbols as FIG. 1 represent the same or identical portions. In the embodiment shown in FIG. 1, the holding portion 6D of piston 6 is formed by extending the circumferential portion of piston head 6C toward the field core 1, but in the embodiment of FIG. 6, the holding portion 6D is formed by expanding and extending the diameter of rear end of the portion of piston 26 which slides on main shaft 5. Such construction can further reduce the weight of piston 26.

Although field core 1 is shown as having eight magnetic poles in FIG. 2, it only needs to have an even number of magnetic poles. However, since the thickness of armature 8 should be larger as the number of magnetic poles decreases, the number of the magnetic poles is desirably an even number not smaller than four (that is, a multipolar structure). If there are eight magnetic poles as shown in FIG. 2, the thickness of armature 8 can be made sufficiently small, which can contribute to substantial reduction in weight of the electromagnetic pump.

Although description has been made on the assumption that coil 2 is wound around every other magnetic poles, it is understood that coil 2 may be wound around all the magnetic poles as long as a magnetic flux forms a loop between adjacent magnetic poles through armature 8.

Figure 7:
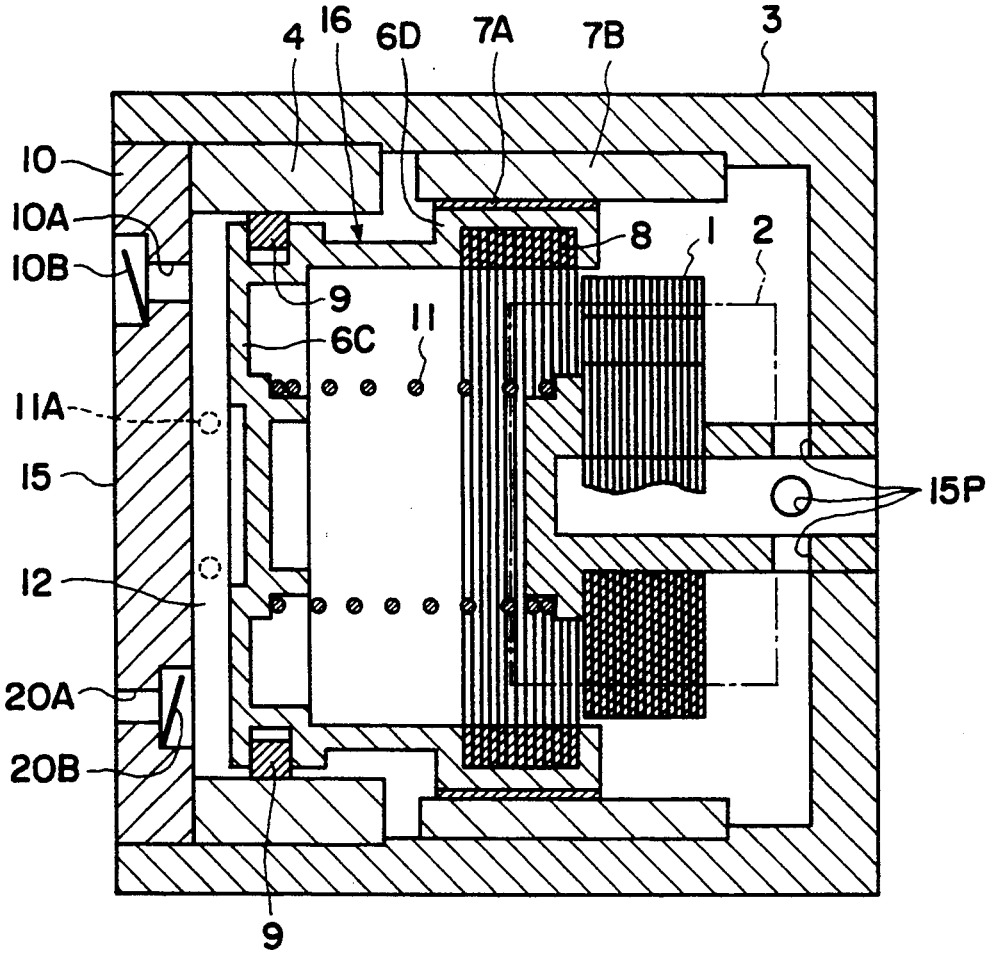
FIG. 7 is a cross-sectional view of the fifth embodiment of the present invention.

In each embodiment above, description has been made on the assumption that piston 6, 16 or 26 is supported by main shaft 5 or 15 placed in casing 3, but if a slide bearing 7A and a cylindrical member 7B is placed in contact with the outer circumferential surface of the piston 16 at the holding portion 6D and the front and rear circumferential surfaces of the piston is supported for sliding by the slide bearing 7A, cylindrical member 7B and cylinder wall 4 as in fifth embodiment shown in FIG. 7, the main shaft is unnecessary.

Although the first and fourth embodiments are constructed such that a fluid is passed through casing 3 and fluid passage 5A when the fluid is sucked into compression chamber 12, conversely the suction valve and the discharge valve may be replaced with each other so that the fluid is passed through casing 3 and main shaft 5 when the fluid is discharged from compression chamber 12.

Further, although compression coil spring 11 is placed between piston 6 and field core 1, it may be place in compression chamber 12 as shown by symbol 11A in FIGS. 6 and 7. Of course, in this case, the compression/pulling actions of the spring should be decided according to the relative position of the armature to the field core in the direction of central axis thereof when the coil is de-energized.

(1) The following effects can be achieved by the electromagnetic pump of the present invention. Since a field core having magnetic poles is located inside an armature, and the armature is formed in a annular shape, a length of magnetic circuit consisting of the field core and armature is shorter as compared with the prior art. Accordingly, the magnetomotive force (ampereturns) of the coils to be wound around the field core can be small, and the number of turns of the coil can be reduced for the same current value. The armature is light in weight because it is annular, and the magnetic material constituting the field core and armature can be made small in amount.

Since the magnetic poles formed in the field core are outwardly projecting, the magnetic gap between the magnetic poles and the armature is outwardly spaced apart for the ends of the spring means for biasing the piston in one direction and the shaft. Consequently, the magnetic fluxes emanating from the electromagnet are difficult to leak even if the spring means is formed of a magnetic material, and thus it is not needed to increase the magnetomotive force of the coils to be wound around the field core.

By the above mentioned factors, the armature and the electromagnet for attracting the armature become small-sized and light in weight, and as a result, the electromagnetic pump can also be made light in weight.

(2) In the conventional electromagnetic pump, the electromagnet has a pair of magnetic poles, which are opposed to the outer surface of armature of the piston. In this case, the magnetic flux emanating from one magnetic pole of the electromagnet passes through the armature of the piston and enters the other magnetic pole of the electromagnet and the magnetic flux interlinks the piston. Since the piston is eventually supported by a housing through a cylinder for supporting, for sliding, the piston head and the like, a circulating current flows through the housing, piston, cylinder and the like if they are formed of electrically conductive material. Accordingly, in the conventional electromagnetic pump, it was required to provide insulating materials for isolating the circulating current in the housing and the like, and as a result, the construction of the electromagnetic pump was complicated.

In accordance with the electromagnetic pump of the present invention, since the supporting members do not constitute a part of the magnetic circuit, the magnetic fluxes emanating from the electromagnet do not interlink the piston. In consequence, even if the main shaft 15 supporting the piston 16 is fixed on both ends thereof to the housing, it is not needed an electrically insulating material in the housing and the like to cut off the circulating current. Therefore, not only the construction of the electromagnetic pump is simple, but also the mechanical strength and stability can be improved.

Since the force of attracting the armature by the electromagnet depends on the quantity of magnetic fluxes between the armature and the magnetic poles, the cross-sectional areas of the magnetic poles and armature can be made smaller as the number of the magnetic poles increases. That is, the thickness of the armature can be decreased as the number of the magnetic poles increases, which can contribute to making the electromagnet and hence the electromagnetic pump small-sized and light-weight.

What is claimed is:

1. An electromagnetic pump comprising:

a casing having a cylinder and a cylinder head, a piston placed for sliding in said cylinder and having on one end thereof a piston head which forms a compression chamber in cooperation with said cylinder and cylinder head the compression chamber having a suction inlet port and valve and a discharge port, an annular armature fixedly held on said piston and having a central axis in the reciprocation direction of said piston, spring means for biasing said piston in one direction, a field core having a plurality of magnetic poles adapted to be opposed to an inner peripheral surface of said armature, having an outer diameter smaller than an inner diameter of said armature, and fixedly placed in said casing so that a central axis of said field core coincides with that of said armature, and one or more coils wound around said field core for magnetizing said plurality of magnetic poles, said armature and piston being attracted by the magnetic force generated when said coil is energized, toward said magnetic poles against a biasing force by spring, and said piston being returned in said one direction by said spring means when the coil is de-energized, whereby said piston reciprocates in said cylinder to cause a fluid sucked into said compression chamber from the suction port to be discharged from the discharge port.

2. A pump of claim 1 wherein said plurality of magnetic poles are outwardly radially extending from a central portion of the field core, and said coil is wound around at least one of them.

3. A pump of claim 2 wherein the number of said magnetic poles is an even number.

4. A pump of claim 2 wherein said coil is wound around at least one of said pair of magnetic poles in order that a pair of magnetic poles adjacent to each other make a closed magnetic path through said armature.

5. A pump of claim 1 wherein said piston, armature and field core are all coaxially disposed.

6. A pump of claim 1 wherein said field core is supported by a main shaft which is in said casing and fixed at at least one end thereof to said casing, and said piston is a hollow cylinder which is engaged with said main shaft for sliding over the circumference thereof.

7. A pump of claim 6 wherein said main shaft is hollow and has openings communicating with the inside and outside of said casing, providing a fluid passage between the outside of said casing and said compression chamber through the inside space of said casing.

8. A pump of claim 7 wherein said spring means is a coil spring which is placed between said piston and field core so as to surround the circumference of said main shaft.

9. A pump of claim 6 wherein said spring means is placed in said compression chamber between said cylinder head and piston head.

10. The pump of claim 1 wherein said field core is fixedly held at a predetermined position in said casing, said armature is supported by a holding member fixedly provided on said piston at a predetermined relative position with respect to said field core and piston, and an outer circumference of said holding member engages for sliding with the inner surface of a slide bearing fixedly provide in said casing.

11. A pump of claim 10 wherein said spring means is placed in said compression chamber between said cylinder and piston head.

12. A pump of claim 10 wherein said spring means is placed between said piston head and one of said field core and said casing.

13. An electromagnetic pump comprising:

a casing having a cylinder and a cylinder head, a piston placed for sliding in said cylinder and having on one end thereof a piston head which forms a compression chamber in cooperation with said cylinder and cylinder head the piston having a sealing ring sliding in the cylinder, an annular armature fixedly held on said piston and having a central axis in the reciprocation direction of said piston, spring means for biasing said piston in one direction, a field core having a plurality of magnetic poles adapted to be opposed to an inner peripheral surface of said armature, having an outer diameter smaller than an inner diameter of said armature, and fixedly placed in said casing so that a central axis of said field core coincides with that of said armature, and one or more coils wound around said field core for magnetizing said plurality of magnetic poles, said armature and piston being attracted by the magnetic force generated when said coil is energized, toward said magnetic poles against a biasing force by spring, and said piston being returned in said one direction by said spring means when the coil is de-energized, whereby said piston reciprocates in said cylinder to cause a fluid sucked into said compression chamber from a valved suction port to be discharged from a valved discharge port, the suction port and discharge port opening to the compression chamber.

* * * * *